US009209533B2

(12) United States Patent
Hashiguchi

(10) Patent No.: US 9,209,533 B2
(45) Date of Patent: Dec. 8, 2015

(54) COAXIAL CONNECTOR SUITABLE FOR CONNECTION OF A FLAT PLATE-LIKE CONNECTION OBJECT

(71) Applicant: JAPAN AVIATION ELECTRONICS INDUSTRY, LIMITED, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 112 days.

(21) Appl. No.: 13/966,582

(22) Filed: Aug. 14, 2013

(65) Prior Publication Data

US 2014/0073179 A1 Mar. 13, 2014

(30) Foreign Application Priority Data

Sep. 10, 2012 (JP) ..... 2012-198057

(51) Int. Cl.
*H01R 3/00* (2006.01)
*H01R 9/05* (2006.01)
*H01R 12/59* (2011.01)

(52) U.S. Cl.
CPC ..... *H01R 9/0515* (2013.01); *H01R 9/0518* (2013.01); *H01R 12/592* (2013.01)

(58) Field of Classification Search
CPC ..... H01R 9/0515; H01R 2103/00; H01R 9/0518; H05K 1/118; H05K 3/326
USPC ..... 439/581, 582, 63, 77, 492, 497
See application file for complete search history.

(56) References Cited

U.S. PATENT DOCUMENTS

| | | | | |
|---|---|---|---|---|
| 6,361,383 | B1 * | 3/2002 | Ko | 439/856 |
| 6,371,806 | B1 * | 4/2002 | Ko | 439/585 |
| 6,416,357 | B1 * | 7/2002 | Ko | 439/585 |
| 6,790,082 | B2 | 9/2004 | Obayashi | |
| 7,972,174 | B2 * | 7/2011 | Maruyama et al. | 439/582 |
| 8,272,894 | B2 * | 9/2012 | Chiu | 439/582 |
| 8,414,328 | B2 * | 4/2013 | Yamakoshi et al. | 439/582 |

(Continued)

FOREIGN PATENT DOCUMENTS

| | | | |
|---|---|---|---|
| CN | 2484671 | Y | 4/2002 |
| CN | 201758233 | U | 3/2011 |
| JP | 2002-324636 | A | 11/2002 |
| JP | 2010-020948 | A | 1/2010 |
| JP | 2011-249206 | A | 12/2011 |

OTHER PUBLICATIONS

Korean Office Action dated Jun. 18, 2014 in Korean Application No. 10-2013-0098058, with English translation.
Chinese Office Action in CN 201310359459.6, issued May 12, 2015, with English translation.

*Primary Examiner* — Hae Moon Hyeon
(74) *Attorney, Agent, or Firm* — Collard & Roe, P.C.

(57) ABSTRACT

A coaxial connector includes a contact, a housing, and a shell. The contact includes a contact portion adapted to be connected to a mating contact of a mating connector and a connecting portion adapted to be connected to a signal conductor. The shell includes a first shell portion having a shell contact portion adapted to be connected to a mating shell of the mating connector and a second shell portion having a shell connecting portion adapted to be connected to a ground conductor. When connecting to a connection object, by sandwiching the connection object between the connecting portion of the contact and the shell connecting portion of the shell, the contact portion of the contact is connected to the signal conductor while the shell contact portion of the shell is connected to the ground conductor.

7 Claims, 7 Drawing Sheets

(56) References Cited

U.S. PATENT DOCUMENTS 8,475,206 B2 * 7/2013 Kubo ..... 439/582
8,876,552 B2 * 11/2014 Taguchi ..... 439/582
2007/0149008 A1 * 6/2007 Pabst ..... 439/95
2007/0264872 A1 11/2007 Kuroda et al.
2012/0164880 A1 * 6/2012 Chiu ..... 439/582

* cited by examiner

COAXIAL CONNECTOR SUITABLE FOR CONNECTION OF A FLAT PLATE-LIKE CONNECTION OBJECT

This application is based upon and claims the benefit of priority from Japanese patent application No. 2012-198057, filed on Sep. 10, 2012, the disclosure of which is incorporated herein in its entirety by reference.

BACKGROUND OF THE INVENTION

1. Field of the Invention

This invention relates to a coaxial connector and, in particular, relates to a coaxial connector that can be used for connection of a flat plate-like connection object.

2. Description of Related Art

An FPC (flexible printed circuit) is known as a flat plate-like connection object. The FPC usually comprises a signal conductor and a ground conductor which are disposed facing each other with an insulating flat plate portion interposed therebetween. A connector is usually used for connecting this type of connection object to, for example, a printed board. Specifically, the connector connected to the connection object is fitted to a mating connector connected to the printed board, thereby connecting the signal conductor and the ground conductor of the connection object to the printed board.

JP-A-2002-324636 (Patent Document 1) discloses one example of a coaxial connector for use in connection of a coaxial cable having a circular cross section.

SUMMARY OF THE INVENTION

However, in the case of the coaxial connector of Patent Document 1, the connecting operation of a shield wire of the coaxial cable is complicated, thus leading to an increase in the number of assembly steps. Further, it has a structural problem that its thickness and length tend to be large. Consequently, the coaxial connector of Patent Document 1 is not suitable for connection of a flat plate-like connection object.

It is therefore an exemplary object of this invention to provide a coaxial connector which is suitable for connection of a flat plate-like connection object.

Other objects of this invention will become clear as the description proceeds.

According to an exemplary aspect of this invention, there is provided a coaxial connector adapted to be connected to a connection object comprising a signal conductor and a ground conductor which are disposed facing each other with a flat plate portion interposed therebetween. The coaxial connector comprises a contact, a housing which holds the contact, and a shell which at least partially covers the housing, wherein the contact comprises a contact portion adapted to be connected to a mating contact of a mating connector and a connecting portion adapted to be connected to the signal conductor, wherein the shell comprises a first shell portion comprising a shell contact portion adapted to be connected to a mating shell of the mating connector and a second shell portion comprising a shell connecting portion adapted to be connected to the ground conductor, and wherein, when connecting to the connection object, by sandwiching the connection object between the connecting portion of the contact and the shell connecting portion of the shell, the contact portion of the contact is connected to the signal conductor while the shell contact portion of the shell is connected to the ground conductor.

DESCRIPTION OF THE EXEMPLARY EMBODIMENTS

Figure 1:
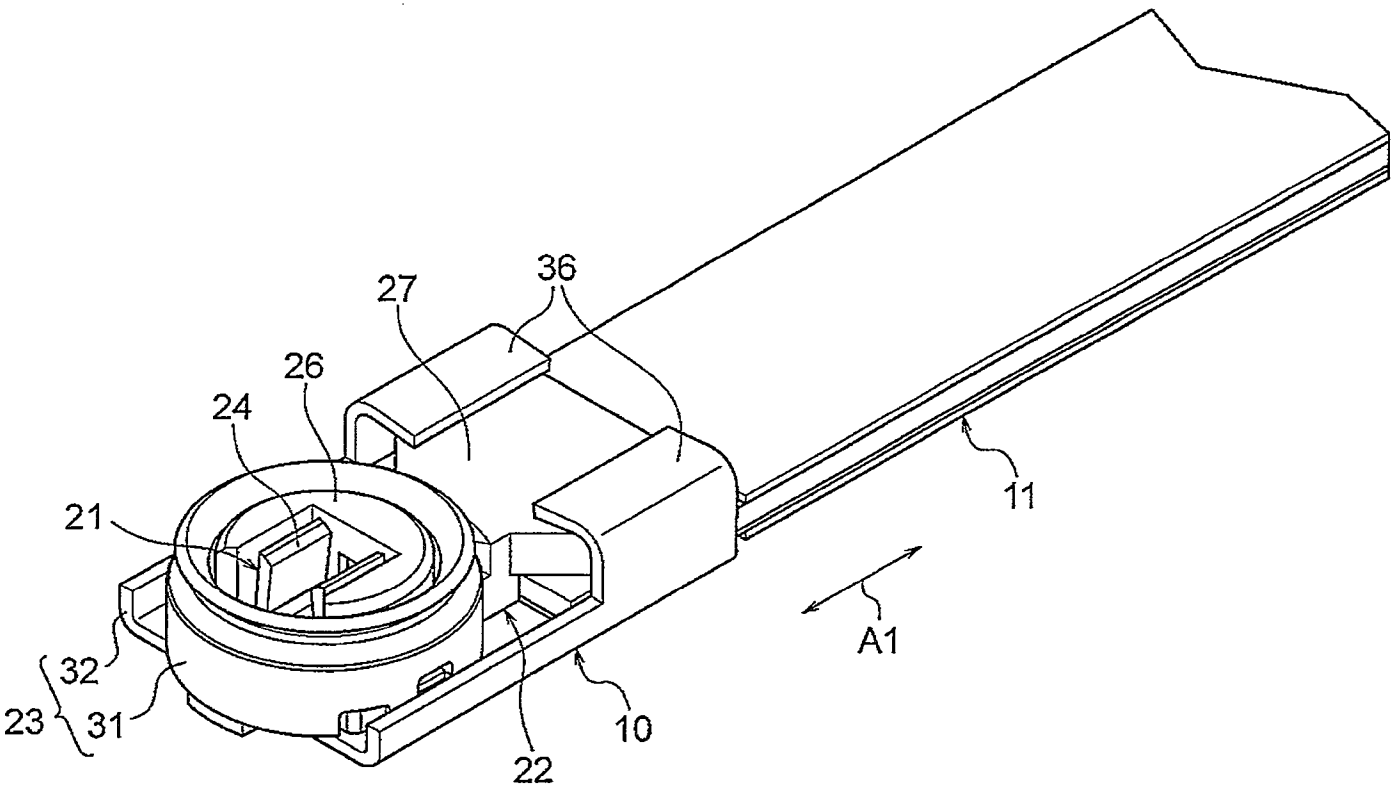
FIG. 1 is a perspective view showing a state where a coaxial connector according to an embodiment of this invention is connected to an FPC.
Figure 2:
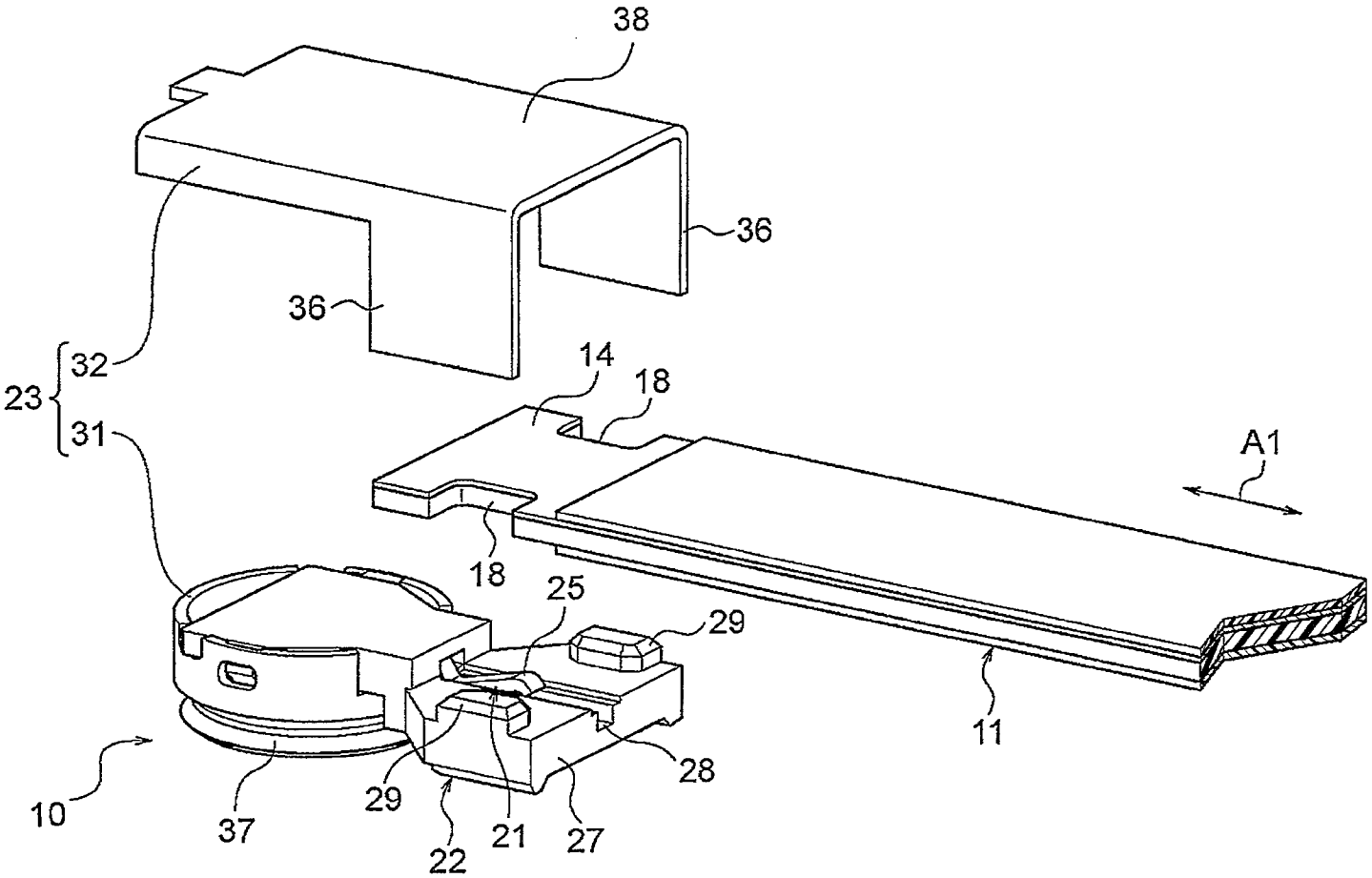
FIG. 2 is a perspective view showing a state before the coaxial connector of FIG. 1 is connected to the FPC.
Figure 3:
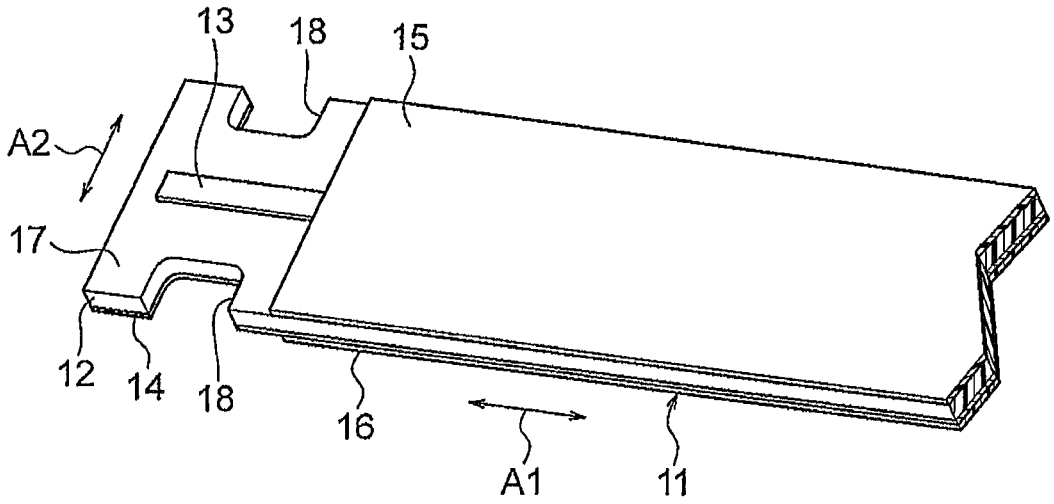
FIG. 3 is a perspective view of the FPC showing the side opposite to that shown in FIG. 2.
Figure 4:
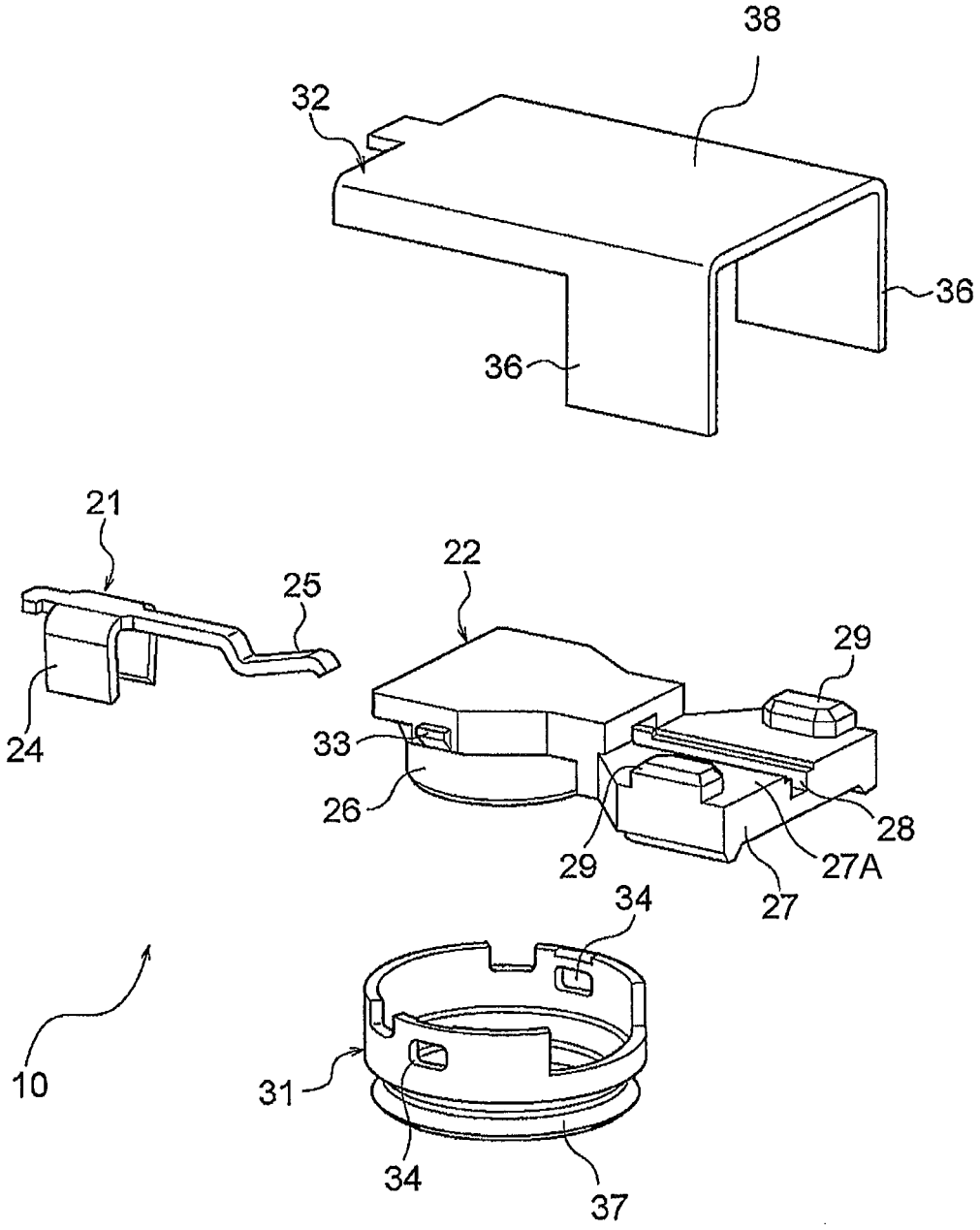
FIG. 4 is an exploded perspective view of the coaxial connector shown in FIGS. 1 and 2.

FIG. 1 shows a state where a coaxial connector 10 according to an embodiment of this invention is connected to an FPC 11, FIG. 2 shows a state before the coaxial connector 10 is connected to the FPC 11, FIG. 3 shows the side, opposite to that shown in FIG. 2, of the FPC 11, and FIG. 4 shows an exploded state of the coaxial connector 10.

The FPC 11 used herein comprises an elongated insulating flat plate portion 12, a signal conductor 13 disposed on the front surface side of the flat plate portion 12, a ground conductor 14 disposed on the back surface side of the flat plate portion 12, and a front insulating layer 15 and a back insulating layer 16 respectively forming a front surface and a back surface of the FPC 11. That is, the FPC 11 forms a connection object having the signal conductor 13 and the ground conductor 14 which are disposed facing each other with the flat plate portion 12 interposed therebetween. At one end portion 17, in a longitudinal direction A1, of the FPC 11, the signal conductor 13 and the ground conductor 14 are exposed on both surfaces, respectively. The end portion 17 is formed with cut-out portions 18 at its both end faces in a width direction A2.

The coaxial connector 10 comprises an elastic metal contact 21, an insulating housing 22 which holds the contact 21, and a shell 23 which at least partially covers the housing 22. The contact 21 integrally comprises a contact portion 24 having two contact pieces and a connecting portion 25 extending and protruding to one side from the contact portion 24.

The housing 22 integrally comprises a columnar portion 26 and a connection object receiving portion 27 extending and protruding radially outward from the columnar portion 26. The contact portion 24 of the contact 21 is disposed at a central portion of the columnar portion 26. A receiving groove 28 is formed on an upper surface 27A of the connection object receiving portion 27. In this receiving groove 28, the connecting portion 25 of the contact 21 is disposed while slightly protruding from the upper surface 27A. The connection object receiving portion 27 is formed with two projections 29 facing each other with the receiving groove 28 interposed therebetween and respectively corresponding to the cut-out portions 18 of the FPC 11.

When connecting the coaxial connector 10 to the FPC 11, the end portion 17 of the FPC 11 is mounted on the connection object receiving portion 27 while the signal conductor 13 faces downward. In this event, the cut-out portions 18 of the FPC 11 are respectively fitted to the projections 29 of the housing 22. As a result, the cut-out portions 18 of the FPC 11 and the projections 29 of the housing 22 jointly form an engaging means which serves for positioning between the signal conductor 13 and the connecting portion 25 of the contact 21 and for engagement therebetween in a direction in which the FPC 11 extends, i.e. the first direction Al.

The shell 23 comprises two components, i.e. a first metal shell portion 31 which is fitted around the columnar portion 26 of the housing 22 from the front surface side (lower side in FIG. 4) and has a shell contact portion 37, and a second metal shell portion 32 which is attached to the connection object receiving portion 27 of the housing 22 from the back surface side and has a shell connecting portion 38. The shell contact portion 37 of the shell 23 is a barrel-shaped component and is fixed to the housing 22 by fitting projections 33 of the housing 22 into holes 34 formed in the shell contact portion 37. When the contact 21 and the shell contact portion 37 of the shell 23 are attached to the columnar portion 26 of the housing 22, a substantially coaxial structure is formed. The connecting portion 25 of the contact 21 is disposed radially outward of the barrel-shaped shell contact portion 37 of the shell 23.

On the other hand, the shell connecting portion 38 of the shell 23 is a component having a 11-shape in cross section and is attached to the housing 22 so as to be fitted over the shell contact portion 37 and the connection object receiving portion 27. When fixing the first shell portion 31 and the second shell portion 32 to the housing 22, the first shell portion 31 and the second shell portion 32 are electrically connected together by a contact portion (not illustrated). In this event, an inner surface of the shell connecting portion 38 is brought into surface contact with the ground conductor 14 of the FPC 11 at the end portion 17 which is mounted on the connection object receiving portion 27. Further, a pair of wing portions 36 of the shell connecting portion 38 are bent inward to embrace the connection object receiving portion 27. As a result, the shell connecting portion 38 is fixed to the connection object receiving portion 27 while adhering to the ground conductor 14 of the FPC 11 and, further, the ground conductor 14 is brought into press contact with the shell connecting portion 38 due to elasticity of the connecting portion 25 of the contact 21 so that the ground conductor 14 and the shell connecting portion 38 are electrically connected together. Simultaneously, the signal conductor 13 at the end portion 17 of the FPC 11 is brought into elastic contact with the connecting portion 25 of the contact 21 so that the signal conductor 13 and the contact 21 are electrically connected together on the outside of the shell contact portion 37 of the shell 23.

In this manner, by sandwiching the FPC 11 between the connecting portion 25 of the contact 21 and the shell connecting portion 38 of the shell 23 when connecting the coaxial connector 10 to the FPC 11, the contact portion 24 of the contact 21 is connected to the signal conductor 13 while the shell contact portion 37 of the shell 23 is connected to the ground conductor 14. According to this coaxial connector 10, it is possible to reduce the number of connection steps and further to reduce the thickness and length of the connector.

Figure 5:
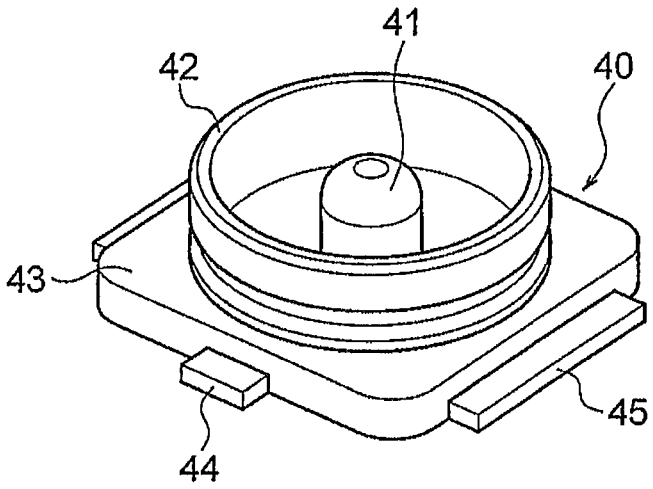
FIG. 5 is a perspective view of a mating connector which is connectable to the coaxial connector shown in FIGS. 1 and 2.
Figure 6:
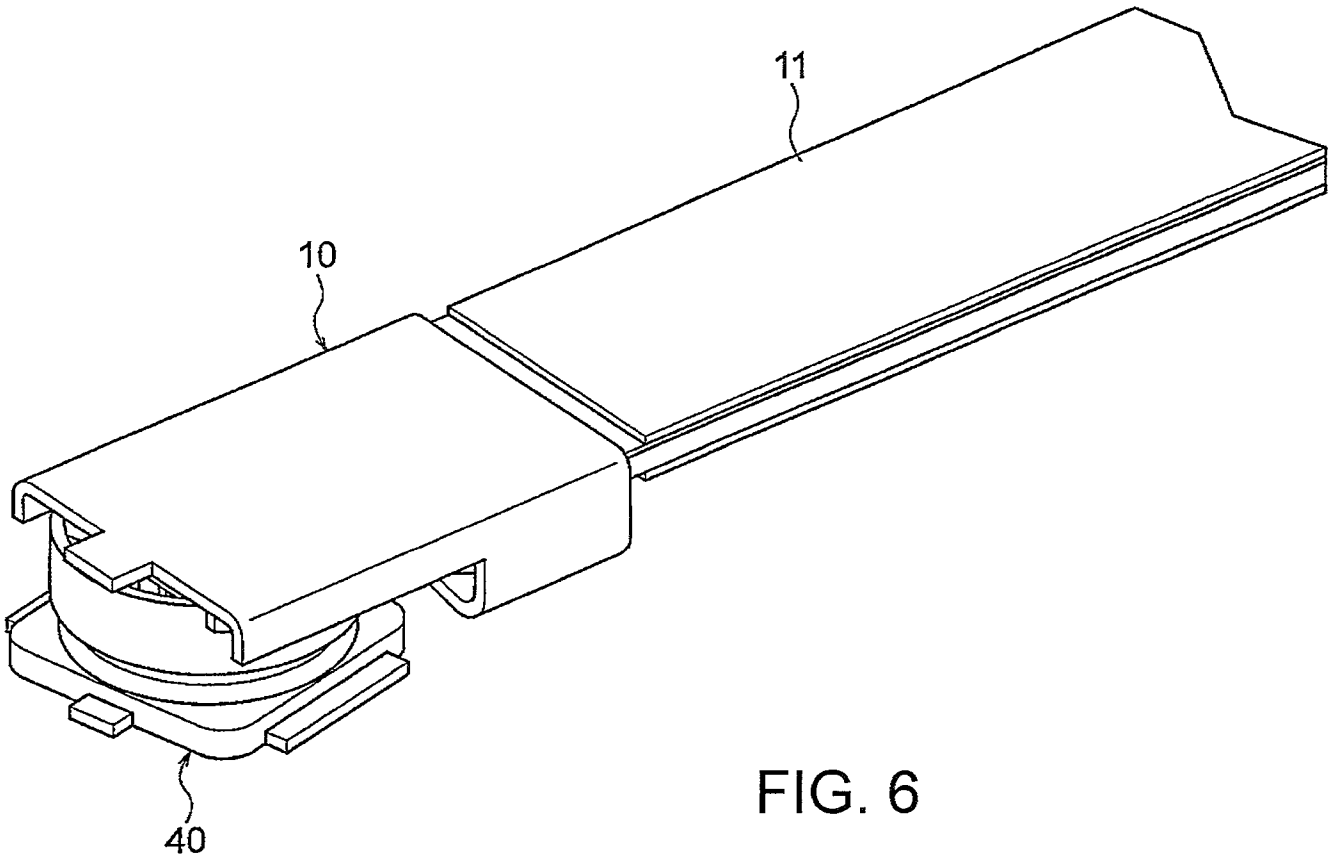
FIG. 6 is a perspective view showing a state where the coaxial connector shown in FIGS. 1 and 2 and the mating connector shown in FIG. 5 are connected together.

FIG. 5 shows a mating connector 40 as a connection counterpart of the coaxial connector 10 and FIG. 6 shows a state where the coaxial connector 10 is connected to the mating connector 40.

The mating connector 40 comprises a conductive mating contact portion 41 which is brought into contact with the contact portion 24 of the contact 21 of the coaxial connector 10, a conductive mating shell 42 which is brought into contact with the shell contact portion 37 of the shell 23 of the coaxial connector 10, and an insulating mating housing 43 holding the mating contact portion 41 and the mating shell 42. The mating connector 40 is mounted on a printed board (not illustrated). Specifically, mating connecting portions 44 and 45 of the mating connector 40 respectively connected to the mating contact portion 41 and the mating shell 42 are connected by soldering or the like to electrical circuit pads (not illustrated) on the printed board.

By fitting the coaxial connector 10 to the mating connector 40 thus mounted on the printed board, the FPC 11 can be easily connected to the printed board.

Figure 7:
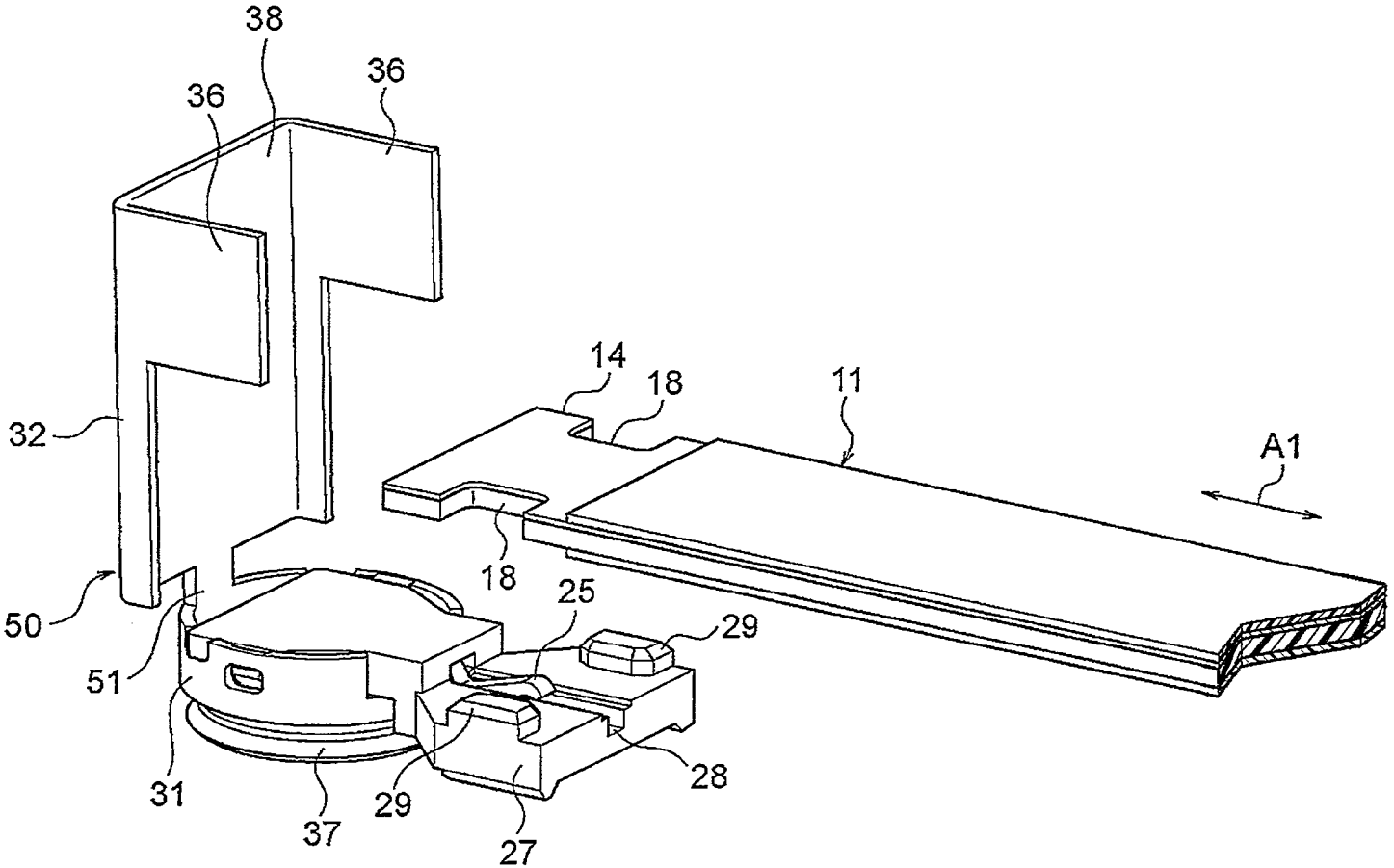
FIG. 7 is a perspective view showing a state before a coaxial connector according to another embodiment of this invention is connected to the FPC.

FIG. 7 shows a state before a coaxial connector 50 according to another embodiment of this invention is connected to the FPC 11. The same reference symbols are assigned to the same portions as those in FIG. 2, thereby omitting description thereof.

In the coaxial connector 50 of FIG. 7, a first shell portion 31 and a second shell portion 32 are integrally formed of a metal, thereby forming a shell 23. That is, the first shell portion 31 and the second shell portion 32 of the shell 23 are coupled together by a coupling portion 51. While bending the coupling portion 51, a shell connecting portion 38 is fitted over a shell contact portion 37 and a connection object receiving portion 27. This makes it possible to reliably obtain electrical connection between the first and second shell portions 31 and 32 of the shell 23 and further to achieve a reduction in the number of components.

In the foregoing description, the FPC is used as the connection object. However, this invention is not limited thereto and may likewise be carried out with a similar connection object.

This invention is not limited to the above-mentioned embodiments and part or the whole thereof can also be described as the following supplementary notes but is not limited thereto.

(Supplementary Note 1)

A coaxial connector 10 adapted to be connected to a connection object 11 comprising a signal conductor 13 and a ground conductor 14 which are disposed facing each other with a flat plate portion interposed therebetween, the coaxial connector comprising:

a contact 21;

a housing 22 which holds the contact; and a shell 23 which at least partially covers the housing, wherein the contact comprises:

a contact portion 24 adapted to be connected to a mating contact 41 of a mating connector 40; and a connecting portion 25 adapted to be connected to the signal conductor, wherein the shell comprises:

a first shell portion 31 comprising a shell contact portion 37 adapted to be connected to a mating shell 42 of the mating connector; and a second shell portion 32 comprising a shell connecting portion 38 adapted to be connected to the ground conductor, and wherein, when connecting to the connection object, by sandwiching the connection object between the connecting portion of the contact and the shell connecting portion of the shell, the contact portion of the contact is connected to the signal conductor while the shell contact portion of the shell is connected to the ground conductor.

The coaxial connector of Supplementary Note 1 is configured such that the connection object is sandwiched between the connecting portion of the contact and the shell connecting portion of the shell, thereby achieving connection to the signal conductor and the ground conductor of the connection object which are disposed facing each other with the flat plate portion interposed therebetween. Therefore, it is possible to reduce the number of connection steps and further to reduce the thickness and length of the connector.

(Supplementary Note 2)

The coaxial connector according to Supplementary Note 1, further comprising engaging means 18, 29 which serves for positioning between the signal conductor and the connecting portion of the contact and for engagement therebetween in a direction A1 in which the connection object extends.

(Supplementary Note 3)

The coaxial connector according to Supplementary Note 1 or 2, wherein the contact portion 24 of the contact is disposed at a central portion and the shell contact portion 37 of the shell is disposed around the contact portion of the contact, thereby forming a coaxial structure.

(Supplementary Note 4)

The coaxial connector according to Supplementary Note 3, wherein the connecting portion 25 of the contact is disposed radially outward of the shell contact portion 37 of the shell, thereby achieving connection between the contact and the signal conductor on the outside of the shell contact portion of the shell.

(Supplementary Note 5)

The coaxial connector according to any one of Supplementary Notes 1 to 4, wherein the shell has a coupling portion 51 coupling together the first shell portion 31 and the second shell portion 32 so that the first shell portion and the second shell portion are integrally formed together.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims

What is claimed is:

1. A coaxial connector adapted to be connected to a connection object comprising a signal conductor and a ground conductor which are disposed facing each other with a flat plate portion interposed therebetween, the coaxial connector comprising:

a contact;

a housing which holds the contact; and a shell which at least partially covers the housing, wherein the contact comprises:

a contact portion adapted to be connected to a mating contact of a mating connector; and a connecting portion adapted to be connected to the signal conductor, wherein the shell comprises:

a first shell portion comprising a shell contact portion adapted to be connected to a mating shell of the mating connector; and a second shell portion comprising a shell connecting portion adapted to be connected to the ground conductor, wherein, when connecting to the connection object, by sandwiching the connection object between the connecting portion of the contact and the shell connecting portion of the shell, the contact portion of the contact is connected to the signal conductor while the shell contact portion of the shell is connected to the ground conductor, and wherein the connecting portion of the contact has elasticity which makes the connecting portion be in elastic contact with the signal conductor and which makes the ground conductor be connected to the shell connecting portion.

2. The coaxial connector according to claim 1, wherein the housing comprises an engaging portion configured to engage with the connection object.

3. The coaxial connector according to claim 2, wherein the contact portion of the contact is disposed at a central portion and the shell contact portion of the shell is disposed around the contact portion of the contact, thereby forming a coaxial structure.

4. The coaxial connector according to claim 3, wherein the connecting portion of the contact is disposed radially outward of the shell contact portion of the shell, thereby achieving connection between the contact and the signal conductor on the outside of the shell contact portion of the shell.

5. The coaxial connector according to claim 1, wherein the contact portion of the contact is disposed at a central portion and the shell contact portion of the shell is disposed around the contact portion of the contact, thereby forming a coaxial structure.

6. The coaxial connector according to claim 5, wherein the connecting portion of the contact is disposed radially outward of the shell contact portion of the shell, thereby achieving connection between the contact and the signal conductor on the outside of the shell contact portion of the shell.

7. The coaxial connector according to claim 1, wherein the shell has a coupling portion coupling together the first shell portion and the second shell portion so that the first shell portion and the second shell portion are integrally formed together.

* * * * *